US007863535B2

(12) United States Patent
Reinking

(10) Patent No.: US 7,863,535 B2
(45) Date of Patent: Jan. 4, 2011

(54) METHOD AND APPARATUS FOR PROCESSING TOOTHBRUSHES

(75) Inventor: Rex E. Reinking, Cedar Rapids, IA (US)

(73) Assignee: The Gillette Company, Boston, MA (US)

( * ) Notice: Subject to any disclaimer, the term of this patent is extended or adjusted under 35 U.S.C. 154(b) by 523 days.

(21) Appl. No.: 10/901,676

(22) Filed: Jul. 29, 2004

(65) Prior Publication Data

US 2006/0021917 A1 Feb. 2, 2006

(51) Int. Cl.
*B07C 5/342* (2006.01)

(52) U.S. Cl. ..... 209/580; 209/552; 209/576; 209/577; 209/587

(58) Field of Classification Search ..... 209/580, 209/552, 576, 577, 587
See application file for complete search history.

(56) References Cited

U.S. PATENT DOCUMENTS

| | | | | | |
|---|---|---|---|---|---|
| 1,432,762 | A | * | 10/1922 | Ladd | 209/536 |
| 2,627,975 | A | * | 2/1953 | Ekstrom et al. | 209/524 |
| 3,563,376 | A | | 2/1971 | Zegna et al. | 209/73 |
| 4,283,623 | A | * | 8/1981 | von Stein et al. | 235/454 |
| 4,482,061 | A | | 11/1984 | Leverett | 209/592 |
| 4,992,949 | A | | 2/1991 | Arden | 364/478 |
| 5,085,325 | A | | 2/1992 | Jones et al. | 209/580 |
| 5,526,119 | A | * | 6/1996 | Blit et al. | 356/402 |
| 5,581,981 | A | * | 12/1996 | Fulkerson et al. | 53/458 |
| 5,813,542 | A | | 9/1998 | Cohn | 209/581 |
| 5,894,938 | A | * | 4/1999 | Ichise et al. | 209/559 |
| 6,315,103 | B1 | * | 11/2001 | Boucherie | 198/395 |
| 6,792,739 | B1 | * | 9/2004 | McConnell et al. | 53/396 |
| 6,893,100 | B1 | * | 5/2005 | Hottmann et al. | 300/7 |
| 2002/0040566 | A1 | | 4/2002 | Boucherie | 53/493 |
| 2002/0170850 | A1 | * | 11/2002 | Bonham et al. | 209/589 |
| 2003/0094346 | A1 | | 5/2003 | Bonham et al. | 198/370.07 |

FOREIGN PATENT DOCUMENTS

| | | |
|---|---|---|
| BE | 1 012 348 A3 | 10/2000 |
| BE | 1 014 460 A3 | 10/2003 |

OTHER PUBLICATIONS

Jun. 16, 2008, European Search Report.

* cited by examiner

*Primary Examiner*—Stefanos Karmis
*Assistant Examiner*—Kalyanavenkateshware Kumar
(74) *Attorney, Agent, or Firm*—George H. Leal

(57) ABSTRACT

A method of processing toothbrushes includes supplying a plurality of toothbrushes with tufts of bristles attached to heads of the toothbrushes. Similar portions of each of the toothbrushes differ in color from each other. A color of the portion of each of the toothbrushes is determined. The toothbrushes are reorganized according to the determined color.

6 Claims, 5 Drawing Sheets

METHOD AND APPARATUS FOR PROCESSING TOOTHBRUSHES

FIELD OF THE INVENTION

The invention relates generally to the field of oral care, and in particular to toothbrushes. More specifically, the invention relates to a method and apparatus for processing toothbrushes.

BACKGROUND OF THE INVENTION

In a prior art method of making toothbrushes, toothbrush handles are first typically formed in an injection molding machine. A common type of handle is made in a two shot mold and has a plastic main body with rubber overmolded on portions of the plastic body to aid in gripability of the handle.

Referring to FIG. 1, after the handles are made they are put into a handle loader 10 at a stapling/finishing machine 12. A hopper at loader 10 will typically contain handles having a number of different colors. For example, all of the handles might have white plastic main bodies, but some of the handles will have red overmolded portions while other handles will have green, blue, yellow or purple overmolded portions. The handles are in a random jumble in the hopper.

Handle loader 10 automatically removes handles from the hopper and introduces the handles into stapling/finishing machine 12 where bristle tufts are stapled to a head of each handle. The bristle tufts are then trimmed and end-rounded in the stapling/finishing machine to complete production of the toothbrush itself.

The finished toothbrushes exit the stapling/finishing machine single file and are moved by a conveyer belt 14 to a tray loader 16. At the tray loader the toothbrushes are placed into trays that each hold a two dimensional array of toothbrushes. These trays are then brought to packaging machines which place the toothbrushes in packaging for shipment to stores.

A problem exists in that the handles are randomly taken by handle loader 10 from the hopper and introduced into stapling/finishing machine 12. This results in a non-uniform color mixture of toothbrushes being produced. For example, three toothbrushes in a row might exit stapling/finishing machine 12 that all have red overmolded rubber portions. This can cause problems because the retailers prefer an even color mixture of toothbrushes. Further, consumers buying club packs which contain a large number of toothbrushes desire an even color mixture so family members can tell their toothbrushes apart. One way of addressing this problem is to manually reorganize the toothbrushes by color, but this is labor intensive and not a desired solution.

SUMMARY OF THE INVENTION

The present invention is directed to overcoming one or more of the problems set forth above. Briefly summarized, according to one aspect of the present invention, a method of processing toothbrushes includes supplying a plurality of toothbrushes with tufts of bristles attached to heads of the toothbrushes. Similar portions of each of the toothbrushes differ in color from each other. A color of the portion of each of the toothbrushes is determined. The toothbrushes are reorganized according to the determined color.

According to another aspect of the invention, an apparatus for processing toothbrushes includes a removal element for removing a toothbrush from a supply of toothbrushes. A color sensor determines a color of a portion of the removed toothbrush. A first buffer receives from the removal element the removed toothbrush and other toothbrushes having the same colored toothbrush portion as the removed toothbrush.

These and other aspects, objects, features and advantages of the present invention will be more clearly understood and appreciated from a review of the following detailed description of the preferred embodiment and appended claims, and by reference to the accompanying drawings.

DETAILED DESCRIPTION OF THE INVENTION

Figure 1:
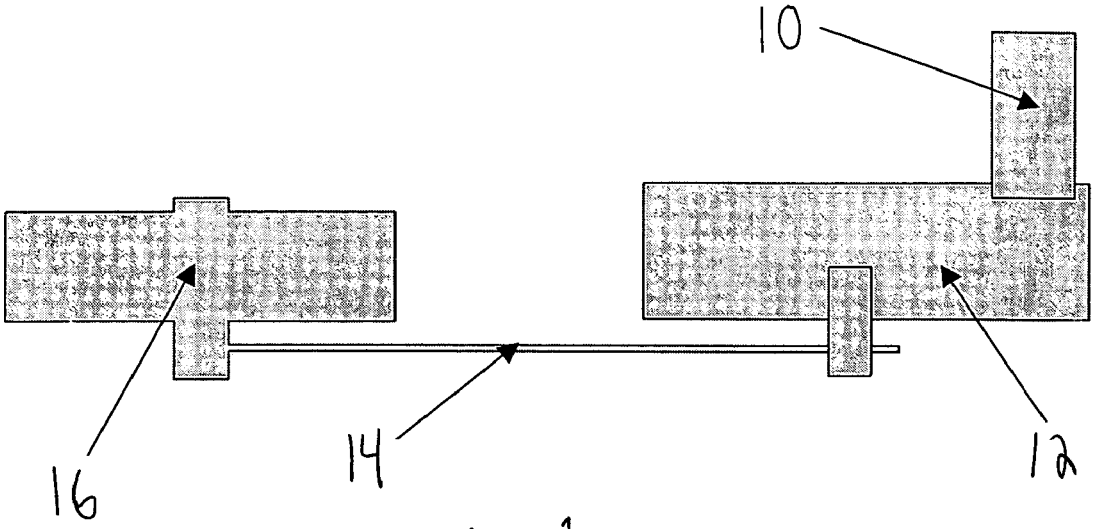
FIG. 1 (PRIOR ART)
FIG. 1 is a schematic illustration of a prior art toothbrush processing apparatus.
Figure 2:
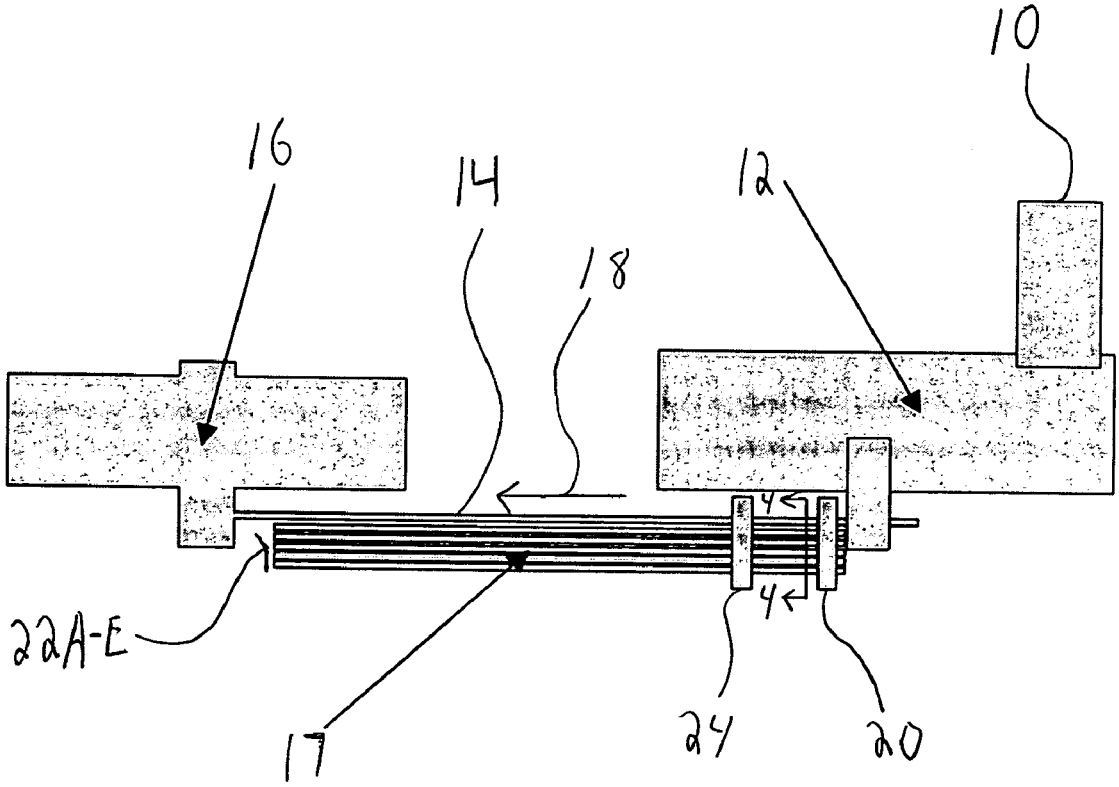
FIG. 2 is a schematic illustration of a toothbrush processing apparatus according to the invention including a color sorter.
Figure 3:
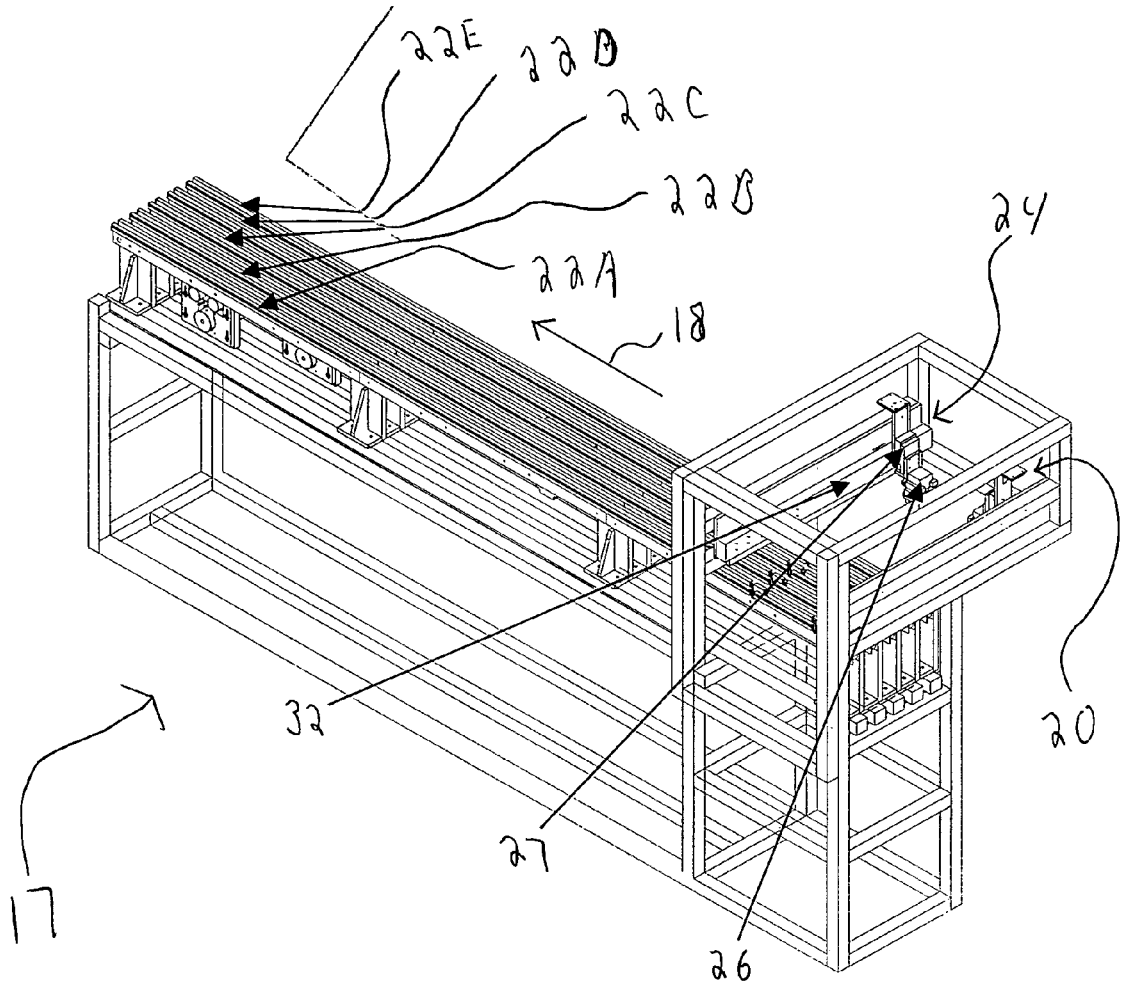
FIG. 3 is a perspective view of the color sorter of FIG. 3.
Figure 4:
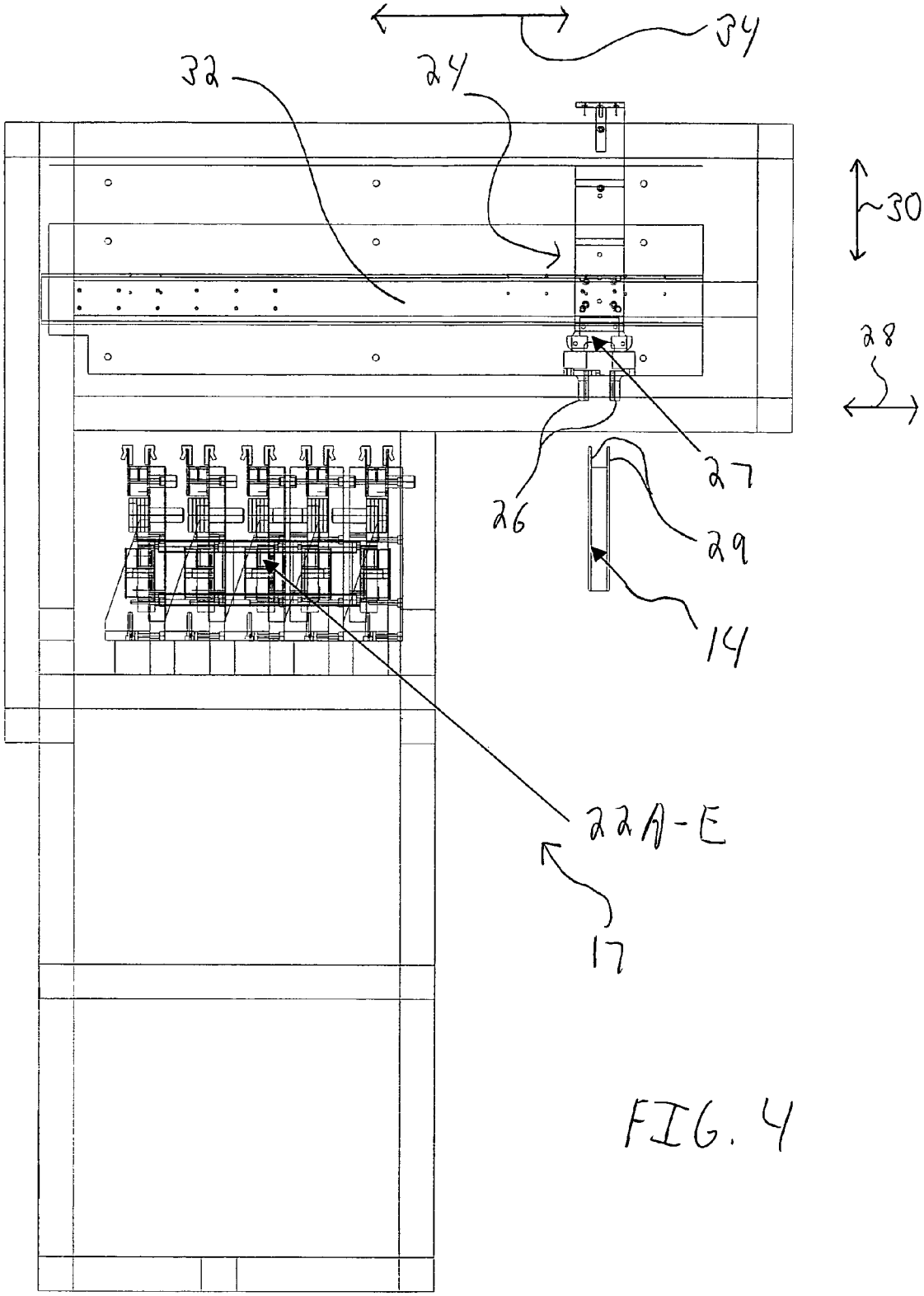
FIG. 4 is a partial sectional view of FIG. 2 taken along the lines 4-4.

Beginning with FIGS. 2-4, the elements 10, 12, 14 and 16 are substantially the same as described with respect to FIG. 1. However, a color sorter 17 has been added to the system. A supply of toothbrushes exit stapling/finishing machine 12 single file and are moved by a conveyer belt 14 in the direction of an arrow 18. A mechanical stop stops a lead toothbrush adjacent a removal element 20. An optical sensor detects the presence of a toothbrush at the mechanical stop and signals removal element 20 to remove the toothbrush from conveyor 14. The removal element will be discussed in more detail below.

A color sensor then determines a color of a portion of the removed toothbrush, for example the rubber overmolded portion of the handle. Once the color is determined, removal element 20 moves the removed toothbrush over one of five buffer conveyors 22A-E (22A being the lowest conveyor in FIG. 2). For example, if the color of the rubber is determined to be red, removal element 22 is moved over conveyor 22A. The removal element then deposits the toothbrush onto conveyor 22A.

The other buffer conveyors 22B-E are designated to respectively hold toothbrushes having different colors. For example, conveyor 22B would hold toothbrushes with yellow rubber portions, conveyor 22C would hold toothbrushes with green rubber portions, and so on. The number of conveyor buffers used are set to match the number of different colored toothbrush portions being produced by stapling/finishing machine 12. Each toothbrush produced by stapling/finishing machine 12 is placed by a color sort into one of buffers 22A-E.

Once a toothbrush is placed on one of conveyors 22A-E, an optical sensor detects this event and signals for that conveyor to be actuated to move the toothbrush in the direction of arrow 18. Another optical sensor detects that the toothbrush has been moved below a return element 24 and signals for the conveyor to be turned off. This parks the toothbrush below the return element and frees up the space below the removal element for the next toothbrush to be placed on that conveyor buffer.

Return element 24 is similar to removal element 20 except that it takes toothbrushes one at a time out of buffers 22A-E and places them back onto conveyor 14 downstream from the mechanical stop mentioned above. The removal element is instructed to remove toothbrushes from buffers 22A-E in a designated sequence in order to feed toothbrushes to tray loader 16 in a desired color sequence.

Removal element 20 and return element 24 have substantially the same parts. These parts will be described in terms of return element 24. A pick-up head in the form of a pneumatically operated gripper 26 is attached to a pneumatic vertical actuator 27. The gripper has jaws which can move towards each other or away from each other in the direction of a double-headed arrow 28 to respectively grab or release a toothbrush. Portions of side walls 29 of conveyor belt 14 are removed so that gripper 26 can grip a toothbrush.

Vertical actuator 27 moves the pick-up head up or down in the direction of a double-headed arrow 30 to move a grasped toothbrush away from one of buffers 22A-E and towards conveyor belt 14. A linear actuator controlled by a servo drive 32 moves vertical actuator 27, and thus gripper 26 back and forth in the direction of a double-headed arrow 34. In this way, toothbrushes can be moved between conveyor belt 14 and buffer conveyors 22A-E.

The following example will assist in understanding this embodiment of the invention. Assume R=Red, B=Blue, G=Green, Y=Yellow and P=Purple. A sequence of toothbrushes coming out of stapling/finishing machine 12 might be in the order RRBGPRYPYYPGBBG. After color sorter 17 reorganizes the toothbrushes, they would continue onto tray loader 16 in the order RGPYBRGPYBRGPYB. This would provide a perfect color mix of toothbrushes Of course, any designated color sequence can be obtained with this system, such as RRBBGGYYPP.

It may happen that, for example, five red toothbrushes come into the color sorter in a row. In this case, four of the five toothbrushes would get buffered on their designated buffer conveyor. These extra brushes get stored to the left in FIG. 2 on their conveyor. When return element 24 later needs a red toothbrush and none is available under removal element 24, the red conveyor is run in the reverse direction (i.e. opposite to arrow 18) to move one of the buffered red brushes under return element 24.

This buffering system can be described as a last in first out (LIFO) system. Each conveyor buffer 22A-E can store up to 10 brushes. In the unlikely event that the capacity for a specific buffer conveyor is exceeded, the extra brushes will fall off the left end of the conveyor into a tote. These extra brushes are either manually reintroduced to their conveyor at a later time when there is room, or are manually introduced to tray sorter 16.

A programmable Logic Controller (PLC) receives input from the optical sensors for determining toothbrush position and from the color sensor for determining the color of a portion of each toothbrush. The PLC directs operation of conveyor 14, buffer conveyors 22A-E, removal element 20 and return element 24.

Figure 5:
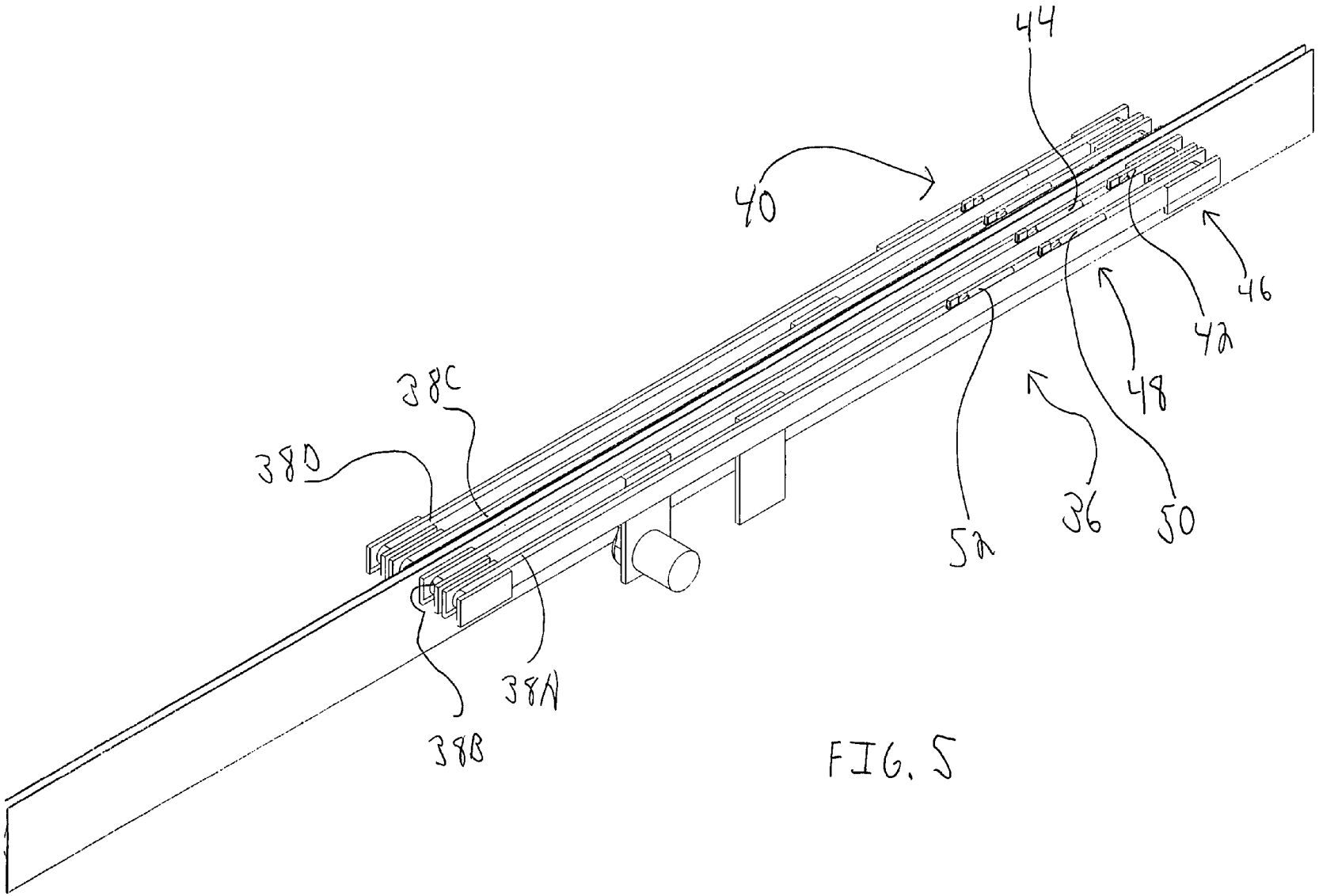
FIG. 5 is a perspective view of a portion of a color sorter.

Turning to FIG. 5, a portion of a color sorter 36 is shown which has only four buffer conveyors 38A-D. Toothbrushes 40 are shown on the conveyors. A toothbrush 42 has just been placed on conveyor 38B by the removal element. Conveyor 38B would now be actuated to move the two toothbrushes on this conveyor to the left until toothbrush 42 is located where a toothbrush 44 is currently located in FIG. 5. This effectively moves toothbrush 42 from a removal zone 46 to a return zone 48, thus freeing up the entire removal zone for receipt of a toothbrush of any of four colors from the removal element.

Now assume return element returned a toothbrush 50 from buffer conveyor 38A to conveyor 14. Buffer conveyor 38A would now be operated to move a toothbrush 52 to the right and park toothbrush 52 in return zone 48. This demonstrates that this is a LIFO system.

The invention has been described with reference to a preferred embodiment. However, it will be appreciated that variations and modifications can be effected by a person of ordinary skill in the art without departing from the scope of the invention.

The invention claimed is:

1. A method of processing toothbrushes, comprising the steps of:

supplying plurality of toothbrushes with tufts of bristles attached to heads of the toothbrushes, similar portions of each of the toothbrushes differing in color from each other;

determining a color of the portion of each of the toothbrushes;

reorganizing the toothbrushes according to the determined color by removing a toothbrush from the supply of toothbrushes and placing the removed toothbrush in a buffer designated for the determined color of the removed toothbrush; and detecting the location of the removed toothbrush on the buffer.

2. The method of claim 1, wherein the supplying step supplies the toothbrushes in single file.

3. The method of claim 2, wherein the removed toothbrush is a lead toothbrush from the single file of toothbrushes.

4. The method of claim 1, wherein the reorganizing step takes the removed toothbrush from its buffer and puts the removed toothbrush from its buffer back into the supply of toothbrushes downstream from where it was first removed from the single file of toothbrushes.

5. The method of claim 1, wherein the reorganizing step takes the removed toothbrush from its buffer and puts the removed toothbrush back into the supply of toothbrushes in a different location from where it was removed from the supply of toothbrushes.

6. The method of claim 1 further comprising the steps of moving the buffer from a first position to a second position; and stopping the buffer at the second position.

* * * * *